US005148994A

United States Patent [19]

Haider et al.

[11] Patent Number: 5,148,994

[45] Date of Patent: * Sep. 22, 1992

[54] SEGMENT FOR DRUM REFINERS AND STRUCTURE PROVIDED THEREWITH

[75] Inventors: Franz Haider; Martin Zehentner; Johann Lileg, all of Graz, Austria; Lars Obitz, Waxholm, Sweden

[73] Assignee: Maschinenfabrik Andritz Actiengesellschaft, Graz, Austria

[ * ] Notice: The portion of the term of this patent subsequent to Sep. 17, 2008 has been disclaimed.

[21] Appl. No.: 624,812

[22] Filed: Dec. 10, 1990

[30] Foreign Application Priority Data

Jan. 23, 1990 [AT] Austria ..... 146/90

[51] Int. Cl.[5] ..... B02C 19/00

[52] U.S. Cl. ..... 241/261.1; 241/295

[58] Field of Search ..... 241/261.1, 261.2, 261.3, 241/294

[56] References Cited

U.S. PATENT DOCUMENTS 4,355,768 10/1982 Johannson ..... 241/261.3
4,936,518 6/1990 Bernhard et al. .
5,048,768 9/1991 Bernhard et al. .

FOREIGN PATENT DOCUMENTS 2323442 11/1980 Fed. Rep. of Germany .

*Primary Examiner*—Mark Rosenbaum
*Assistant Examiner*—John M. Husar
*Attorney, Agent, or Firm*—Panitch Schwarze Jacobs & Nadel

[57] ABSTRACT

The invention relates to a segment for drum refiners provided with comminuting, in particular grinding surfaces with a projection of hammerhead-shaped cross section for anchoring on the rotor or rotor drum shell. The invention is characterized mainly in that the segment (2') of T-shaped cross section consists of a slim stem (2'') and a slim flange (2''') and that the transition surfaces from stem to hammerhead (12) viewed in cross section form an angle ($\beta$) of between 15 and 75 degrees, preferably of about 55 degrees, open towards the hammerhead and conveniently equal on both sides with the axis of symmetry (8) of the hammerhead of symmetrical cross section. The ratio of the stem thickness (D) to the segment height (H) conveniently amounts to between 1:5 and 1:9, preferably about 1:7, and the flange thickness (FD) on the stem is about equal to the thickness of the stem. The transistions between flange and stem and between stem and hammerhead conveniently extend along comparatively large radii of curvature (R), for instance along a radius (R) which is equal to one half the time to one time the least thickness (S) of the flange.

84 Claims, 6 Drawing Sheets

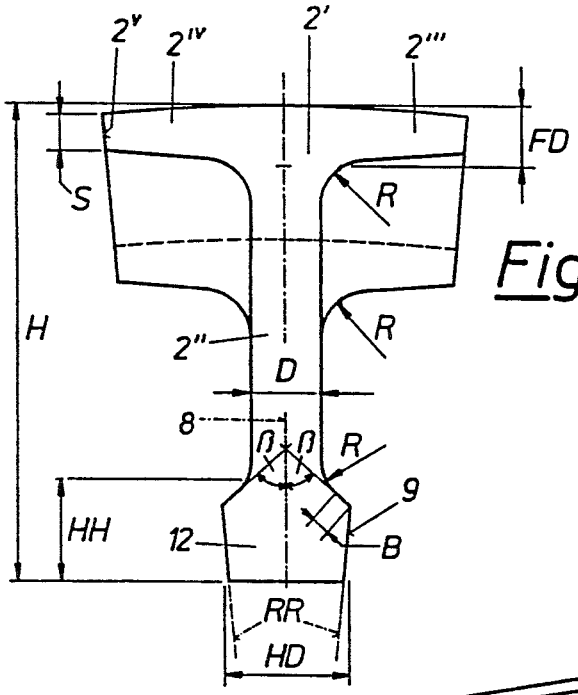
Fig. 2
Fig. 3
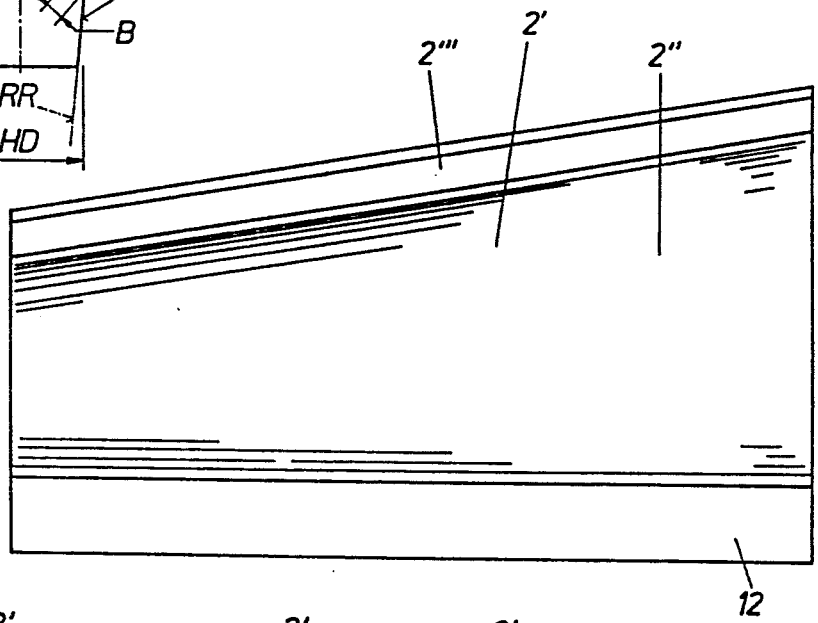
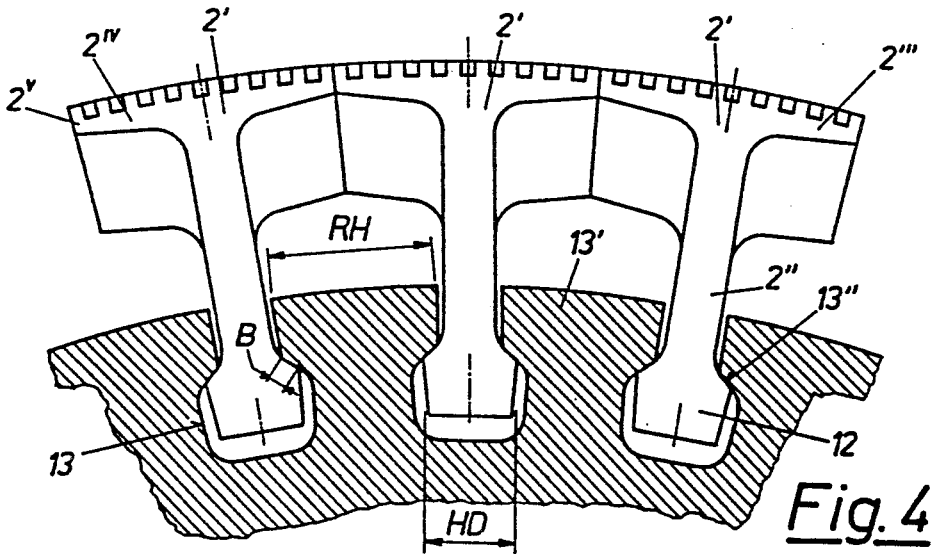
Fig. 4

SEGMENT FOR DRUM REFINERS AND STRUCTURE PROVIDED THEREWITH

The invention relates to a segment provided with comminuting, in particular grinding surfaces, for drum refiners having a projection of hammerhead-shaped cross section for anchoring on the shell or periphery of the rotor or the rotor drum in particular for comminuting or grinding of fibrous material wet or mixed with water, the engine-driven rotor of e.g. approximately horizontal rotary kraft and at least one, in particular two surfaces consisting of comminuting and/or grinding elements and/or grinding plates composed of comminuting segments and/or grinding segments, said surfaces being inclined to the rotor axis and/or extending approximately parallel thereto, each of the inclined surfaces has a diameter away from the material feed, and, if at least two surfaces provided with comminuting segments or the like and inclined to the rotor axis are provided, their inclination is opposed to the rotor axis and the segments conveniently serve for the guidance of the steam generated during the comminuting operation. The invention also relates to structures having such segments on the rotor periphery of the drum refiner.

The comminuting, in particular grinding surfaces of drum refiners, depending on the material to be comminuted, are subject to more or less heavy wear. It has therefore been proposed to divide such comminuting surfaces into segments provided with projections of hammerhead-shaped cross-section for anchoring on the rotor or the rotor drum.

It is the object of the invention to form such comminuting or grinding surfaces composed of segments or these segments themselves particularly lightweight and still particularly durable and resistant to wear. The fit or seat of these segments is to be particularly secure, but easily releasable for repeatedly required replacement.

These objects are achieved on the basis of the segment initially characterized by providing for the T-shaped segment to consist of a slim stem and a slim flange, and for the transition surfaces from the stem to the hammerhead to form an angle open towards the hammerhead and conveniently equal on both sides in cross section of between 15 and 75 degrees, conveniently about 55 degrees, with the axis of symmetry of the hammerhead of symmetrical cross section. The flange is conveniently at least partially slimmer than the stem, resulting in advantages in respect of material expenditure, strength, saving in weight and service life. The ratio of stem thickness to segment height is conveniently one of between 1:3 and 1:9, perferably about 1:5, and the thickness of the flange on the stem is about equal to the thickness of the stem. The transitions between flange and stem and between stem and hammerhead conveniently extend according to comparatively large radii of curvature, for instance according to a radius equal to one half the time to one time the least thickness of the flange. Such embodiments are lightweight and resistant, so that the effect of centrifugal forces and axial stress in the rotor area is greatly reduced. Added to this is a considerable increase of operational safety. Still, a good retention of the segments can be achieved if measured in cross section, the thickness of the hammerhead and its height exceed the thickness of the stem by at least 50 percent, at most by about 200 percent, conveniently by about 70 to 100 percent. A further reduction of weight in the area of the grinding surfaces can be achieved without loss of strength if the flange flanks taper from the cross-sectional axis of symmetry towards the flange ends, the lateral flanks of the hammerhead possibly extending along radial planes directed through the rotor axis. Depending on the utilization, however, the flange flanks may be of approximately even thickness viewed in cross section or the ends of the flange flanks viewed in cross section may be bent approximately towards the rotor axis. In the latter case, particularly good strength values are obtained even at saving in material.

According to a further development of the invention, the insides of the flanges and parts of the stems, particularly in view of the slimness of the stems and the flanges of the segments, can form channels for the steam generated in operation. The steam generated during comminuting or grinding can be evacuated in a particularly easy manner if recesses for the passage of the steam generated during operation to the channel are provided on the flange edges of the segments on the stem.

A particularly convenient configuration of the comminuting or grinding surfaces can be obtained according to the invention if the releasable anchoring of the hammerheads of the segments is effected by rotor webs or ribs of hammerhead-shaped cross section grasping the segment hammerheads, the thickness of the rotor hammerheads substantially exceeding the thickness of the segment hammerheads. The thickness of the rotor hammerheads conveniently exceeds the thickness of the segment hammerheads by 50 to 100 percent, preferably by about 75 percent. A safe fit or seat of the segments also during operation is obtained in particular if the rotor webs or ribs are provided with surfaces inclined towards the stem in the transition area from the hammerhead to the stem, the angle of inclination of the surface being virtually equal to the angle of inclination of the segment in the transition area between segment hammerhead and segment stem and/or if viewed in cross section, the hammerhead-shaped rotor webs or ribs are provided with rounded-off transitions in the area of accommodation or reception of the segment hammerheads and gripping means for anchoring the segments in the rotor are provided. Secure fit or seat and still good releasability of the segments are conveniently obtained according to the invention if the segment hammerheads are grasped with clearance by the hammerhead-shaped rotor webs or ribs and gripping means are provided between the segment hammerhead end close to the rotor axis and the bottom of the rotor shell grooves formed by the hammerhead-shaped rotor webs or ribs, for instance in the form of wedges, elliptical or oval, in particular at least partially slotted hollow bodies, in particular pipes or unround bolts or eccentrics. A particularly secure fit or seat of the segment hammerheads is obtained if the supporting length and width of the transition surfaces between segment stem and hammerhead of the segment or the corresponding parts of the rotor webs or ribs is short or small as compared to the hammerhead width or stem length, for instance 15 to 30 percent, e.g. about 20 percent of the entire hammerhead width.

In order to obtain a particularly secure anchoring of the segments in the rotor grooves, the bottom of the groove between the rotor webs or ribs is adapted to the shape of the respective anchoring means, e.g. rounded or flattened.

Efficient steam evacuation is assured according to the invention if steam evacuation channels into which the channels formed by the recesses conveniently empty are formed between the stems and flange halves of adjacent segments and the outer surfaces of the hammerheads of the rotor webs or ribs.

The invention is explained by means of exemplary embodiments with reference to the accompanying drawings wherein FIG. 1 represents an overall view of a drum refiner;

FIGS. 2 and 3 are front and side views of one of the segments according to the invention used therein in enlarged scale as compared to FIG. 1;

FIG. 4 shows a number of segments arranged side by side in front view together with a rotor portion retaining these in cross-sectional view;

Figure 1:
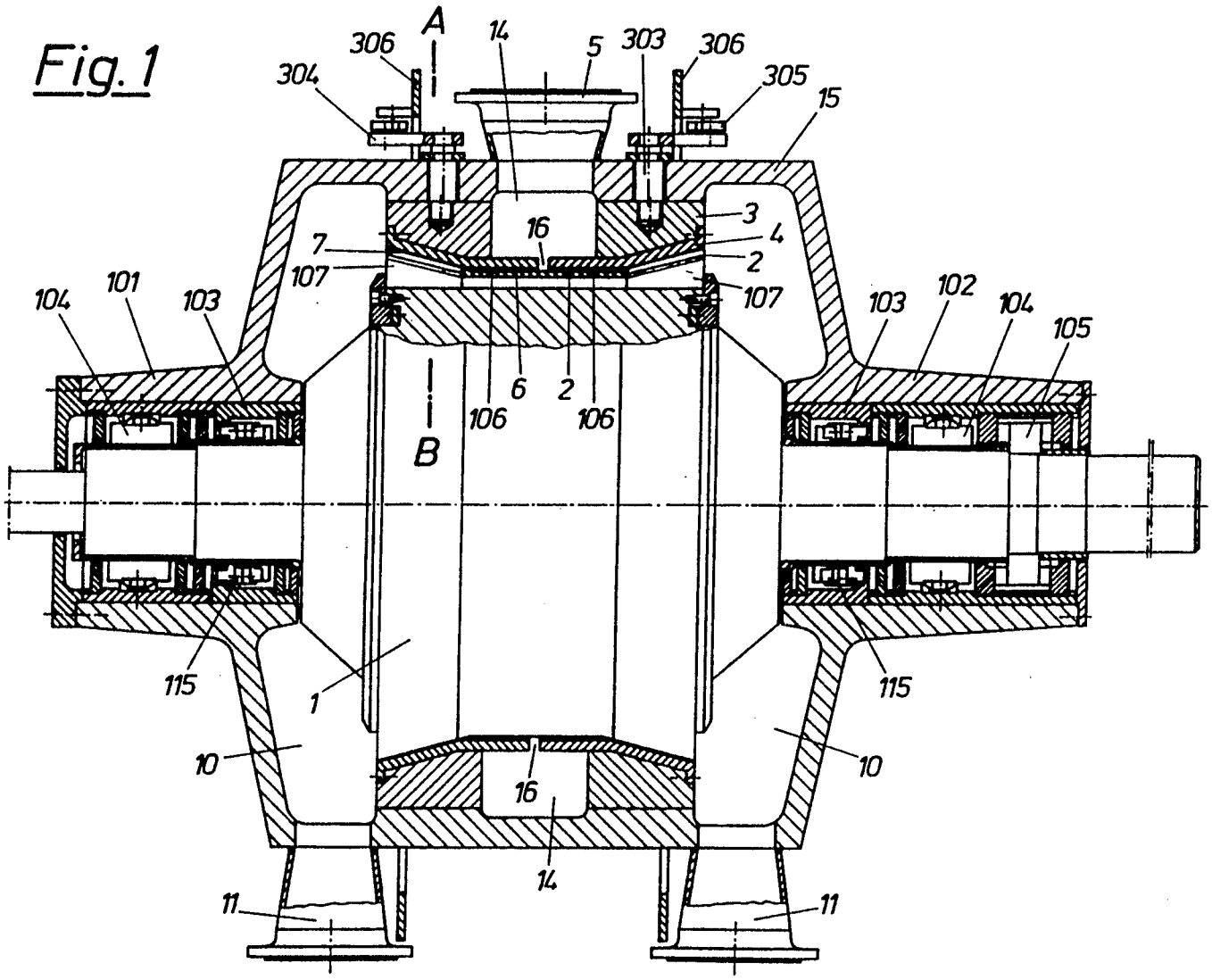

According to FIG. 1, a drum refiner is provided with a cylindrical rotor 1 supported on both sides on which grinding plates 2 composed of segments are attached, the grinding zone being formed first parallel to the axis and then slightly inclined towards the horizontal by the grinding plates. Opposing grinding plates 4 are provided on horizontally adjustable stator rings 3. The chips are fed to the drum refiner via screws in the radially extending material feed(s) 5 of which one, two or a plurality may be provided and evenly distributed over the circumference of the drum refiner; the chips may be distributed to both sides in the precomminuting zone 6 parallel to the axis and comminuted substantially in the grinding zone 7 inclined to the rotor axis. The fibrous material is conveyed to a cavity 10 of the refiner housing from whence it exits at 11 and passes to a pressure cyclone disposed downstream for the recovery of heat and can thus be separated. According to the invention, the grinding plates 2 are composed of segments 2'. FIGS. 2 to 4 show embodiments with dimensions particularly adjusted to practice. Anchoring projections 12 are provided in corresponding rotor grooves, both of hammerhead-shaped cross section, for the individual grinding plate segments 2'. As particularly evident from FIGS. 2 and 4, the segments 2' of T-shaped cross section consist of a slim stem 2'' and a slim, conveniently at least partially even slimmer, flange 2''', the ratio of the stem thickness D to the segment height H being one of between 1:5 and 1:9, preferably about 1:7, and the flange thickness FD on the stem being approximately equal to its thickness, the transition surfaces from stem to hammerhead 12 viewed in cross section forming an angle $\beta$ open towards the hammerhead and conveniently equal of between 15 and 75 degrees, conveniently about 55 degrees, with the axis of symmetry 8 of the segment symmetrical in cross section and the transitions between flange and stem and between stem and hammerhead extending along comparatively large radii of curvature, for instance along a radius R approximately equal to the smallest thickness S of the flange. Moreover, the thickness HD of the hammerhead 12 and its height HH measured in cross section conveniently exceed the stem thickness D by at least 50 percent, at most by about 200 percent, conveniently by about 70 to 100 percent. The weight of the total embodiment can be reduced not only by the aforementioned slim configuration of stem and flanges, but also additionally by providing for the flange flanks $2^{IV}$ to taper from the cross sectional axis of symmetry 8 towards the flank ends $2^{V}$. This is conveniently achieved by providing for the lateral flanges 9 of the hammerhead 12 to extend approximately along radial planes RR directed through the rotor axis.

Figure 5:
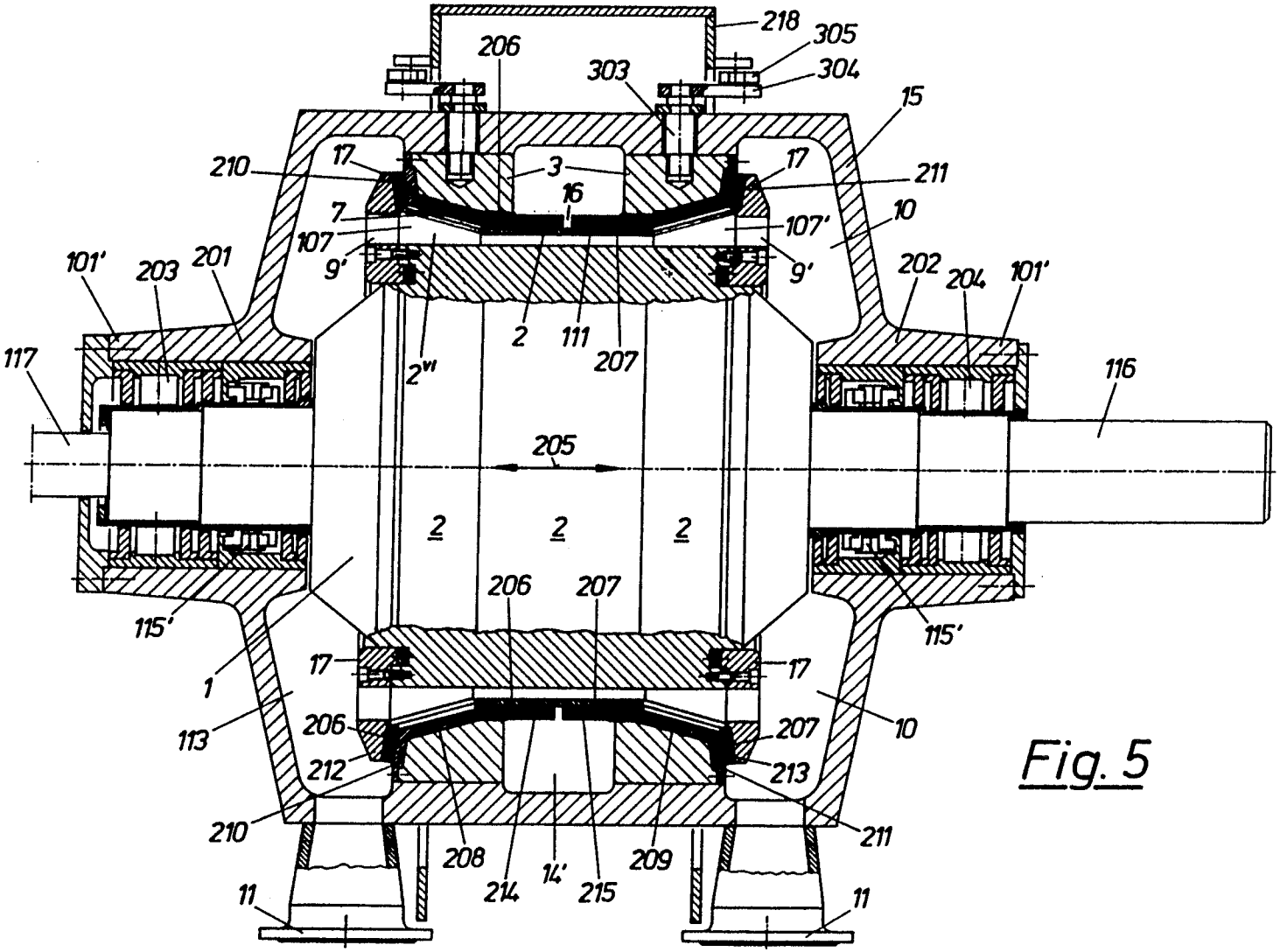
FIG. 5 represents a further overall view of a drum refiner with a steam evacuation outlet from the grinding surface.

The variant according to FIG. 5 is provided with material feeds (not represented) directed approximately tangentially to the rotor 1.

In the embodiment according to FIG. 1 as well as in the embodiment according to FIG. 5, the material to be comminuted is conveyed from the radial or tangential material feeds into an annular space 14 or 14' enclosing the outside of the rotor 1 within the housing 15 of the apparatus. This annular space 14 or 14' communicates on the inside with an annular material feed gap 16 which is provided in the cross-axial median plane of the apparatus or its housing between the comminuting or grinding surfaces 6 parallel to the axis and thus between the comminuting or grinding surfaces 7 inclined to the rotor axis.

Figure 7:
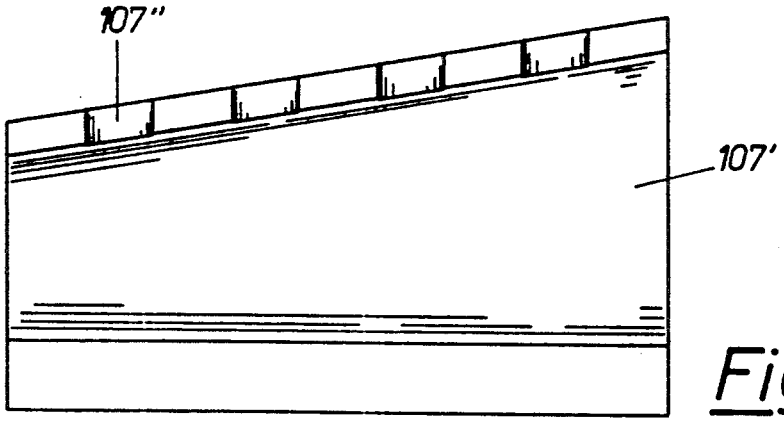
FIG. 7 represents an elevational view according to sectional plane A—B in FIG. 6.
Figure 6:
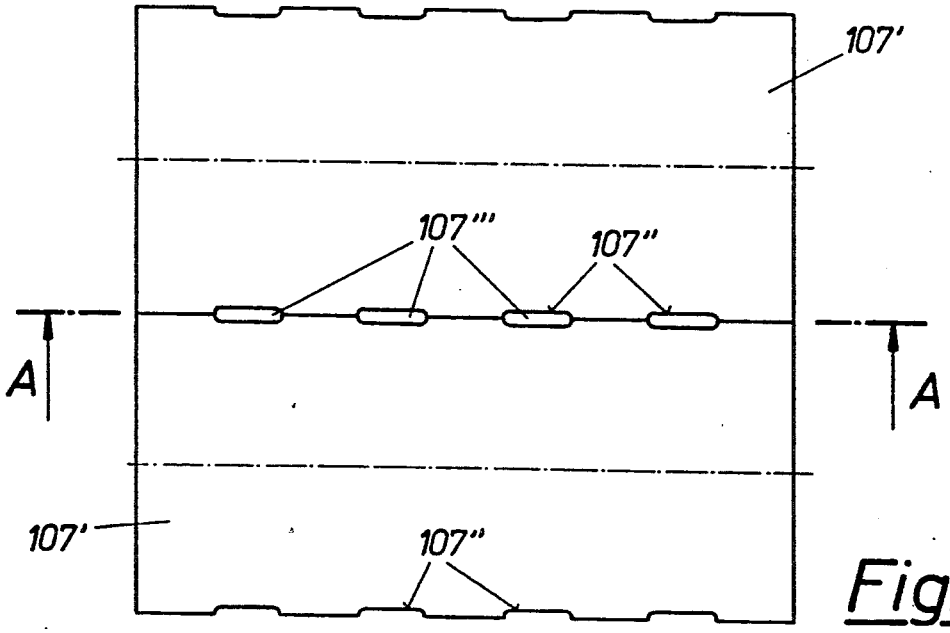
FIG. 6 shows a top plan view of two grinding segments thereof in enlarged scale as compared to FIG. 5.

The embodiment according to FIG. 5 is particularly convenient in that the steam generated during the comminuting operation is evacuated from the grinding gap in a particular manner. A further advantage of the invention thus resides in the fact that the steam is evacuated directly at the site of its generation and thus at the highest possible pressure. A back-flowing of steam and thus an impediment of the feeding of chips or the like is thus largely avoided. As evident from FIGS. 7 and 8, such a steam evacuation is first of all provided by the insides of the flanges 2''' and parts of the stems 2'' forming channels $2^{VI}$ for the guidance of the steam generated in operation and moreover, recesses 107'' for the passage of the steam generated during operation to the channels $2^{VI}$ on the stem 2'' are provided on the flange edges. The respective segments forming the frustoconical grinding plates 107 bear the reference number 107' in FIG. 5.

By the channels 107''' extending perpendicularly to the rotor axis and formed by the recesses 107'', a good separation of steam and optionally its separation from the solids is achieved and clogging up of the channels is prevented because the channels 107''' empty into the channels $2^{VI}$. The good evacuation of the steam permits not only the recovery of the steam at the highest possible pressure, but also—in relation to the available grinding surface—a higher specific utilization of energy. The steam evacuation channels $2^{VI}$ are conveniently formed between stems 2'' and flange halves $2^{IV}$ of adjacent segments and the outer surfaces of the hammerheads of the rotor webs 13' into which the channels 107''' formed by the recesses 107'' conveniently empty. The connecting channels $2^{VI}$ are passed by means of the extension channels 9' through supporting rings 17 connected to the rotor 1 and carrying grinding plates 212, 213 forming an angle of nearly 90 degrees with the rotor axis. The grinding plates 212, 213 cooperate with opposing grinding plate extensions 210, 211 attached to the stator rings 3 and forming approximately or exactly identical angles with the rotor axis as the grinding plates 212, 213.

As evident from FIGS. 1 and 5, the known refiners are of similar configuration as far as the remaining parts of the apparatus are concerned. In the preferably horizontally divided refiner housing 15, the cylindrical rotor 1 is supported in bearings 101, 102 and 101' on both sides, roller bearings or sliding bearings, in particular tilting segment sliding bearings depending on diameter, capacity and number of revolutions per minute. In the embodiment according to FIG. 1, the rotor shaft ends are supported in the bearing parts 103, 104 or 105 of the bearings 101, 102 secure against axial displacement. In the embodiment according to FIG. 5, a floating support to be described later on is provided. On the rotor, grinding plates 106 composed of grinding segments are attached in zone 6 and grinding plates 107 composed of grinding segments are provided in zone 7, the grinding plates 106 arranged along a cylindrical rotor portion serving for the precomminution of the chips and the grinding plates 107 forming an angle with the rotor axis serving for defibration. By the shape of the grinding plate 107, an inclination of the grinding zone to the horizontal of between 5 and 45 degrees, preferably 15 degrees, is achieved. As evident from FIG. 8, this angle may gradually increase. The additional grinding plates of steeper inclination to the rotor axis according to FIG. 5 will be discussed later on.

The axially displaceable stator rings 3 equipped with the opposing grinding plates 4 engage with a plurality of eccentric bolts 303 distributed over the periphery and exactly fixing the stator ring 3 in the desired position axially as well as radially. The stator ring(s) 3 thus do not have to be guided on the outer periphery and may have clearance in relation to the housing 15.

To adjust the grinding gap, the eccentric bolt 303 can be rotated via a lever 304 positively attached thereon and a connecting rod 305 connected thereto , all the connecting rods of one stator ring, as evident from FIG. 1, being precisely and uniformly adjusted by means of a regulating ring 306 moved hydraulically or mechanically by the adjusting elements. A simultaneous adjustment of both stator rings will be described later on with reference to FIG. 5.

The regulating rings 306 are preferably formed in two parts adapted to the housing and guided by suitable roll bodies connected to the housing. The regulating rings 306 are arranged concentrically in relation to the stator ring 3 and preferably above the pivoting range of the levers 304.

As a result of the symmetrical arrangement of the stator rings 3, the adjusting means is also arranged symmetrically in relation to the median line; the two regulating rings 306 are adjustable independently from one another in order to be able to compensate differences in the dimensions of the grinding gap on both sides, for instance due to different thermal expansion of housing and rotor.

As evident from FIG. 1, the chips are fed radially via one to four material feed(s) 5 with orifices on the periphery. As described above, the chips are precomminuted in the horizontal grinding gap and symmetrically distributed in both directions. The wood is defibrated in the adjustable grinding gap inclined to the horizontal. The ground material is then conveyed to the interior 10 of the refiner housing and evacuated at 11 together with the steam generated and directed into the space 10.

The bearings are sealed against the steam in the refiner housing by means of sealing units 115. A motor, preferably a direct current motor, of substantially lower output than the main motor, can be installed at the free shaft end 116 in order to reduce the power starting peak. By this embodiment modified in relation to known refiners, the instant refiner can be operated with numbers of revolution of up to 3,600 rpm.

The invention is also suitable for refiners with perpendicularly extending rotor shaft for the configuration of the grinding surfaces as well as for steam evacuation. It may be used for the comminution of other fibrous materials and possibly even of leather scraps, water or other liquids being added to the precomminuted material under certain circumstances.

The embodiment according to FIG. 5 differs from that according to FIG. 1. mainly by the form of the grinding segments and steam evacuation as well as the type of material feed, by the particular support of the rotor and the modified stator adjustment. In this case, the material is fed in two places approximately tangentially in relation to the rotor 1 into the annular space 14' from which the material is then conveyed to the grinding plates and the like. The shaft ends 116, 117 of the rotor 1 and thus the rotor itself are supported floatingly in this case. To this end, hydrostatic sliding bearings 203 and 204 are provided in the bearings 201 and 202. The bearings are again sealed against the steam in the refiner housing by sealing means 115'. Double arrow 205 shows the rotor motion and floating rotor support made possible by the previously described support of the rotor. Although it would suffice for only one stator to be adjustable in the present case, both stators 3 and thus the opposing grinding plates or the like 206, 207 attached thereon are adjustable; these grinding plates or the like are provided, in addition to the frustoconical parts 208, 209, as mentioned above with opposing grinding plate extensions 210, 211 enclosing a larger angle, namely one of nearly 90 degrees, with the rotor axis than the parts 208, 209. As already mentioned, additional grinding plates 212, 213 extending at the same inclination to the rotor axis as the opposing grinding plate extensions 210, 211 and supported by special rings 17 connected to the rotor 1 cooperate with the extensions 210, 211.

The adjustment of the stators 3 and thus of the opposing grinding plates or the like 206 to 211, but also of the cylindrically formed opposing grinding plates 214, 215, is effected in a manner similar to that shown in FIG. 1 by means of the parts 303 to 305, although in the instant case simultaneously and in opposing directions via curved hoops 218 uniformly displaced by means of adjusting elements. In view of the floatingly supported rotor, the adjustment of just one stator would be conceivable in this case. The second stator would then be fixedly supported in the housing. Mobility for the adjustment of the grinding gaps is assured by the free axial displaceability (floating support) of the rotor.

Figure 8:
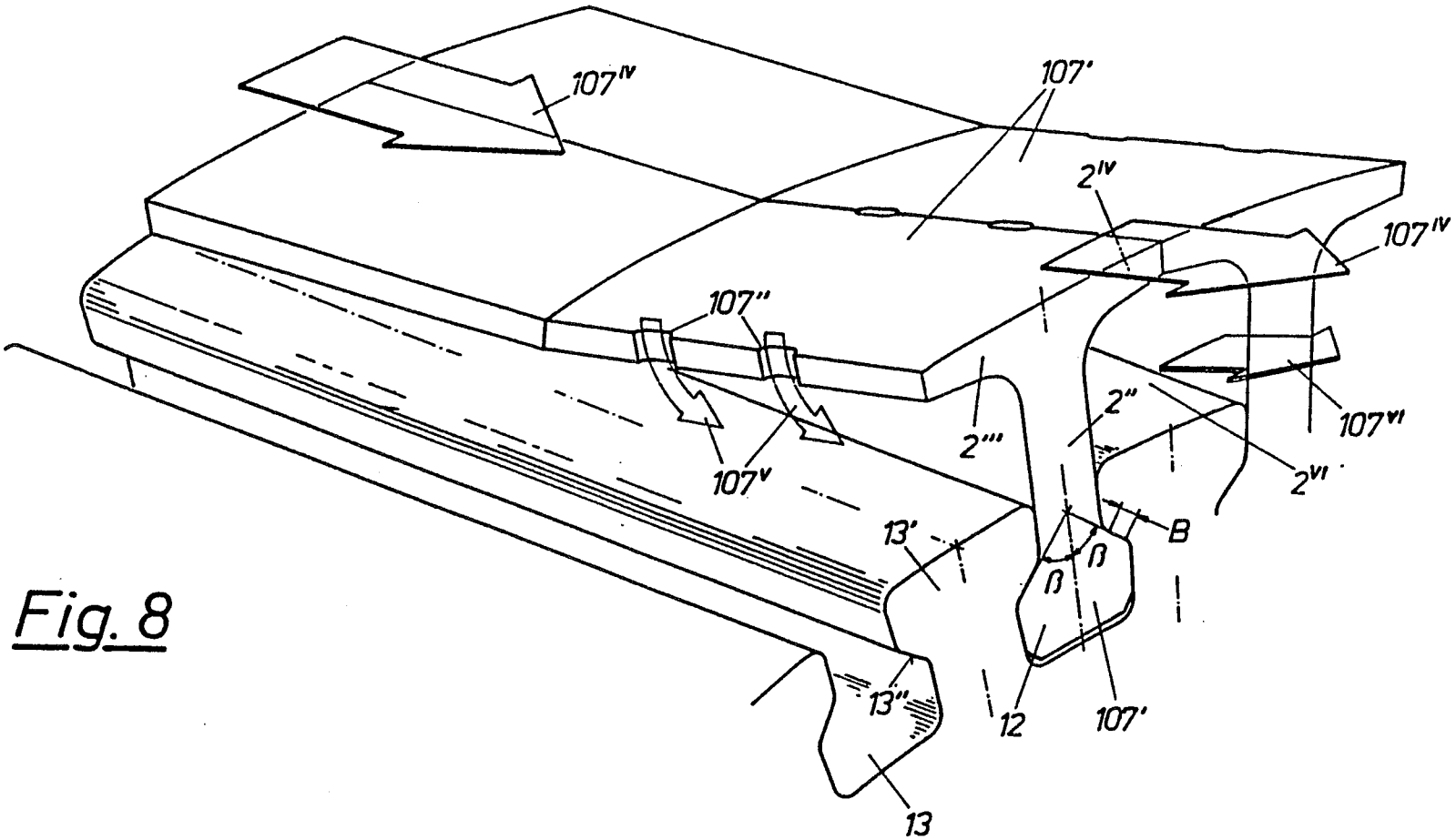
FIG. 8 is an axonometric representation of a portion of the grinding surface with the associated support of the segments in the rotor and FIGS. 9 to 11 show various embodiments of the secure retention of the segments in the rotor.
Figure 9:
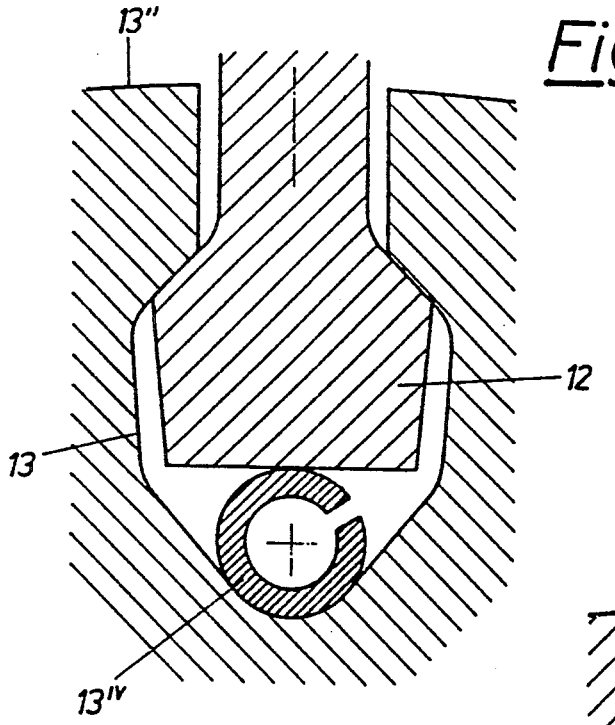
Figure 10:
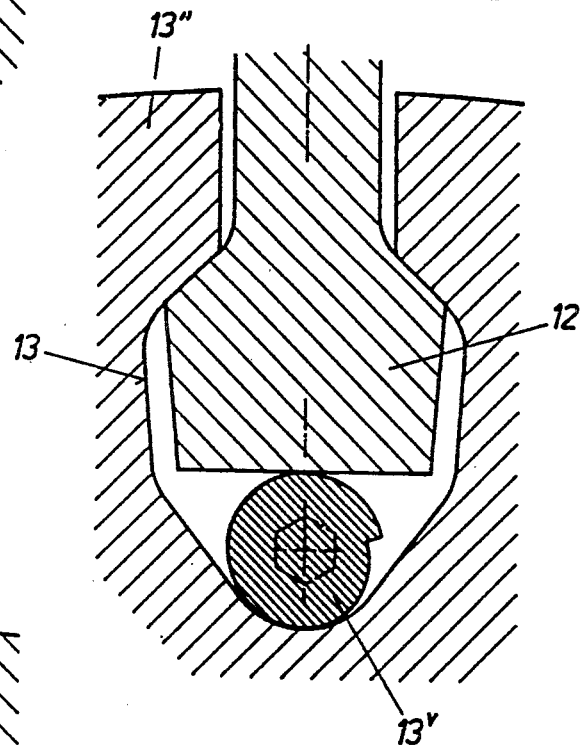
Figure 11:
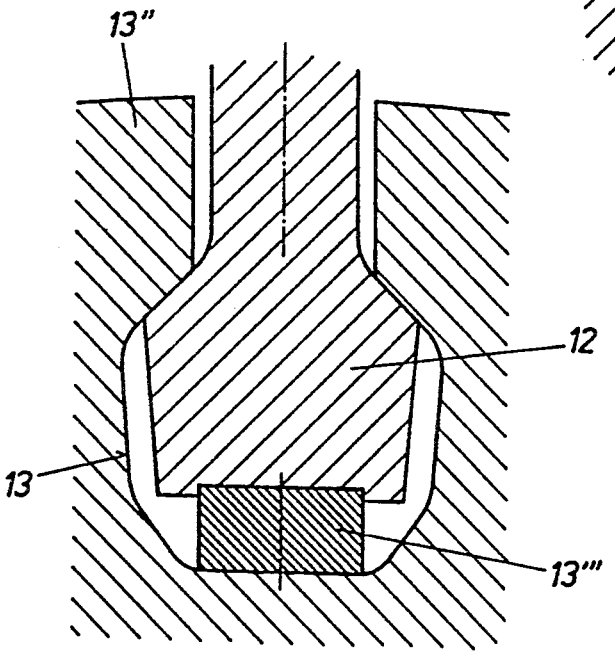

FIG. 8 particularly clearly shows the movement of the material—arrows $107^{IV}$—and the evacuation of steam—arrows $107^{V}$ and $107^{VI}$.

FIGS. 4 and 8 to 11 show that the releasable anchoring of the hammerheads 12 of the segments is assured by rotor webs or ribs 13' of hammerhead-shaped cross section grasping the segment hammerheads, the thickness RH of the rotor hammerheads substantially exceeding the thickness HD of the segment hammerheads, preferably by 50 to 100 percent, conveniently by about 75 percent, and the rotor webs or ribs 13' in the transition area from the hammerhead to the stem having surfaces 13'' inclined to the stem whose angles of inclination are largely identical to the angle of inclination $\beta$ of the segments 2' in the transition area between segment hammerhead 12 and segment stem 2''. For reasons of strength, it is convenient for the hammerhead-shaped rotor webs or ribs 13' to have rounded transitions viewed in cross section in the area of the reception of the segment hammerheads 12 and for gripping means for anchoring the segments to be provided in the rotor. For practical execution, this gripping attachment can be obtained in such a manner that the segment hammerheads 12 are grasped with clearance by the hammerhead-shaped rotor webs or ribs 13' and gripping means, for instance in the form of wedges 13''', elliptical or oval, in particular slotted pipes 13$^{IV}$ or unround bolts and/or eccentrics are provided between the segment hammerhead end close to the rotor axis end and the bottom of the rotor grooves 13 formed by the hammerhead-shaped rotor webs or ribs 13'.

In summarizing, it should be noted that the slim embodiment of the stem 2'' of the segments is so particularly convenient because the mass and thus the stress in the segment and in the refiner rotor are considerably reduced. The angle $\beta$ of the transition surfaces between stem and hammerhead (see FIGS. 2 and 8) in the range between 15 and 75 degrees results in an optimation of the interaction of the influences of friction, surface pressure, spring action as a function of the values of centrifugal force, surface quality and the required bearing tolerances, all in relation to the segments and the rotor parts retaining them. In this context, it may be convenient according to the invention to form the supporting length or width B of the transition surfaces between segment stem 2'' and hammerhead 12 of the segment and/or the corresponding parts 13, 13'' of the rotor webs or ribs 13' short or small in relation to the hammerhead width HD and/or the stem length, for instance of about 15 to 30 percent of the entire hammerhead width HD. A small supporting length or width B results in increased surface pressure in the hammerhead area and as a result in a more intimate contact of the machined surfaces. The small supporting length also provides greater latitude for the formation of good transitions between the individual surfaces of the stem and the hammerhead. A small head width HD of the hammerhead can reduce the nominal stress in the rotor and thus increase the operational reliability. By means of the flanges 2''', 2$^{IV}$, 2$^{V}$ tapering towards their ends in cross section, stress gradients can be reduced. The large radii of curvature R provided serve for the prevention of stress peaks in the segment.

According to the invention, the aforementioned fastening variants supplement the measures for obtaining a good, secure fit or seat of the segments and thus of the exact alignment of the grinding surfaces supporting or having these segments. The gripping means shown in FIGS. 9 to 11 assure not only a secure fit or seat of the segments in the grooves 13, but also a simple and rapid releasing and reattaching of the segments. Above all, damaging of the particularly exactly formed surfaces in mounting and dismantling is prevented. Relative movement of the surfaces of the segment and of the rotor parts gripping it and the danger or frictional contact are prevented. Depending on the type of securing means, the bottom of the groove 13 is deepened in view of a particularly convenient embodiment in view of stress.

We claim:

1. A segment for drum refiners for grinding of fibrous material having grinding surfaces, said drum refiners having a rotor, said rotor having a convex outer surface, said rotor being engine-driven, said rotor having an axis, said drum refiner having a material feed, said segment being provided with a projection of hammerhead-shaped cross-section for anchoring on said convex outer surface of said rotor, said hammerhead having an axis of symmetry, said rotor being provided with at least one surface provided with grinding elements composed of said grinding segments, said surfaces being inclined to said rotor axis and said at least one inclined surface having a diameter increasing away from said material feed, said segment being of T-shaped cross section with a stem and a flange, said stem and said flange being of slim configuration, said projection of hammerhead-shaped cross section having a head situated at the end of the segment nearest to said rotor axis, transition surfaces being provided between said stem and said head, and said transition surfaces from stem to said head viewed in cross section forming an angle of between 15 and 75 degrees open towards said head with the axis of symmetry of the hammerhead being symmetrical in cross section.

2. The segment according to claim 1, wherein said at least one surface extends approximately normally to said rotor axis.

3. The segment according to claim 1, wherein said at least one surface extends approximately parallel to said rotor axis.

4. The segment according to claim 1, wherein at least two surfaces provided with grinding elements inclined to the rotor axis are provided and wherein said surfaces are of opposing inclination to the rotor axis.

5. The segment according to claim 1, comprising means being adapted to serve for the guidance of the steam generated during the grinding operation.

6. The segment according to claim 1, wherein said angle is one of about 55 degrees.

7. The segment according to claim 1, wherein said angle is equal on both sides.

8. The segment according to claim 1, wherein the flange is formed at least partially slimmer than the stem.

9. The segment according to claim 8, wherein the flange thickness on the stem is about equal to its thickness.

10. The segment according to claim 8, wherein the ratio of the stem thickness to the segment height is one of between 1:3 and 1:9.

11. The segment according to claim 9, wherein the ratio of the stem thickness to the segment height is one of about 1:5.

12. The segment according to claim 1, wherein there are transition surfaces between said flange and said stem and wherein said transition surfaces between said flange and said stem and between said stem and said head extend along comparatively large radii of curvature.

13. The segment according to claim 1, wherein said transition surfaces extend along a radius of curvature equal to about one half the time to one time the least thickness of the flange.

14. The segment according to claim 1, wherein the thickness of said head and its height measured in cross section exceed the thickness of the stem by between at least 50 percent and at most 200 percent.

15. The segment according to claim 14, wherein the thickness of said head and its height measured in cross section exceed the thickness of the stem by about 70 to 100 percent.

16. The segment according to claim 1, wherein said flange has flanks and ends and wherein said flanks taper from said cross section axis of symmetry towards the flange ends.

17. The segment according to claim 1, wherein said flange has flanks and wherein said flanks are of approximately equal thickness viewed in cross section.

18. The segment according to claim 1, wherein said flange has two ends and wherein said ends are curved approximately towards the rotor axis viewed in cross section.

19. The segment according to claim 1, wherein said head has lateral flanks which extend approximately like radial planes directed through the rotor axis.

20. The segment according to claim 1, wherein said flange has insides nearer the rotor axis than its outsides, said insides of the flanges and at least parts of the stems of adjoining segments serving as channels for the guidance of the steam generated in operation.

21. The segment according to claim 20, wherein said flange has edges and wherein recesses for the passage of the steam generated in operation to said channels are provided on said flange edges.

22. A segment for drum refiners for grinding of wet fibrous material having grinding surfaces, said drum refiners having a rotor, said rotor having a convex outer surface, said rotor being engine-driven, said rotor having an axis, said drum refiner having a material feed, said segment being provided with a projection of hammerhead-shaped cross section for anchoring on said convex outer surface of said rotor, said hammerhead having an axis of symmetry, said rotor being provided with at least one surface provided with grinding elements composed of said grinding segments, said surfaces being inclined to said rotor axis and said at least one inclined surface having as diameter increasing away from said material feed, said segment being of T-shaped cross section with a stem and a flange, said stem and said flange being of slim configuration, said projection of hammerhead-shaped cross section having a head situated at the end of the segment nearest to said rotor axis, transition surfaces being provided between said stem and said head, and that said transition surfaces form stem to said head viewed in cross section form an angle of between 15 and 75 degrees open towards said head with the axis of symmetry of the hammerhead being symmetrical in cross section.

23. The segment according to claim 22, wherein said at least one surface extends approximately normally to said rotor axis.

24. The segment according to claim 22, wherein said at least one segment extends approximately parallel to said rotor axis.

25. The segment according to claim 22, wherein at least two surface provided with grinding elements inclined to the rotor axis are provided and wherein said surfaces are of opposing inclination to the rotor axis.

26. The segment according to claim 22, comprising means being adapted to serve for the guidance of the steam generated during the grinding operation.

27. The segment according to claim 22, wherein said angle is one of about 55 degrees.

28. The segment according to claim 22, wherein said angle is equal on both sides.

29. The segment according to claim 22, wherein the flange is formed at least partially slimmer than the stem.

30. The segment according to claim 29, wherein the ratio of the stem thickness to the segment height is one of between 1:3 and 1:9.

31. The segment according to claim 29, wherein the flange thickness on the stem is about equal to its thickness.

32. The segment according to claim 30, wherein the ratio of the stem thickness to the segment height is one of about 1:5.

33. The segment according to claim 22, wherein there are transition surfaces between said flange and said stem and wherein said transition surfaces between said flange and said stem and between said stem and said head extend along comparatively large radii of curvature.

34. The segment according to claim 22, wherein said transition surfaces extend along a radius of curvature equal to about one half the time to one time the least thickness of the flange.

35. The segment according to claim 22, wherein the thickness of said head and its height measured in cross section exceed the thickness of the stem by between at least 50 percent and at most 200 percent.

36. The segment according to claim 35, wherein the thickness of said head and its height measured in cross section exceed the thickness of the stem by about 70 to 100 percent.

37. The segment according to claim 22, wherein said flange has flanks and ends and wherein said flanks taper from said cross section axis of symmetry towards the flange ends.

38. The segment according to claim 22, wherein said flange has flanks and wherein said flanks are of approximately equal thickness viewed in cross section.

39. The segment according to claim 22, wherein said flange has two ends and wherein said ends are curved approximately towards the rotor axis viewed in cross section.

40. The segment according to claim 22, wherein said head has lateral flanks which extend approximately like radial planes directed through the rotor axis.

41. The segment according to claims 22, wherein said flange has insides nearer the rotor axis than its outsides, said insides of the flanges and at least parts of the stems of adjoining segments serving as channels for the guidance of the steam generated in operation.

42. The segment according to claim 41, wherein said flange has edges and wherein recesses for the passage of the steam generated in operation to said channels are provided on said flange edges.

43. A segment for drum refiners having comminuting surfaces, said drum refiners having a rotor, said rotor having a convex outer surface, said rotor being engine-driven, said rotor having an axis, said drum refiner having a material feed, said segment being provided with a projection of hammerhead-shaped cross section for anchoring on said convex outer surface of said rotor, said hammerhead having an axis of symmetry, said rotor begin provided with at least one surface provided with comminuting elements composed of said comminuting segments, said surfaces being inclined to said rotor axis and said at least one inclined surface having a diameter increasing away form said material feed, said segment being of T-shaped cross section with a stem and a flange, said stem and said flange being of slim configuration, said projection of hammerhead-shaped cross section having a head situated at the end of the segment nearest said rotor axis, transition surfaces being provided between said stem and said head, and said transition surfaces form stem to said head viewed in cross section forming an angle of between 15 and 75 degrees open towards said head with the axis of symmetry of the hammerhead being symmetrical in cross section.

44. The segment according to claim 43, wherein said at least one surface extends approximately normally to said rotor axis.

45. The segment according to claim 43, wherein said at least one surface extends approximately parallel to said rotor axis.

46. The segment according to claim 43, wherein at least two surfaces provided with comminuting elements inclined to the rotor axis are provided and wherein said surfaces are of opposing inclination to the rotor axis.

47. The segment according to claim 43, comprising means being adapted to serve for the guidance of the steam generated during the comminuting operation.

48. The segment according to claim 43, wherein said angle is one of about 55 degrees.

49. The segment according to claim 43, wherein said angle is equal on both sides.

50. The segment according to claim 43, wherein the flange is formed at least partially slimmer than the stem.

51. The segment according to claim 50, wherein the ratio of the stem thickness to the segment height is one of between 1:3 and 1:9.

52. The segment according to claim 50, wherein the flange thickness on the stem is about equal to its thickness.

53. The segment according to claim 51, wherein the ratio of the stem thickness to the segment height is one of about 1:5.

54. The segment according to claim 43, wherein there are transition surfaces between said flange and said stem and wherein said transition surfaces between said flange and said stem and between said stem and said head extend along comparatively large radii of curvature.

55. The segment according to claim 43, wherein said transition surfaces extend along a radius of curvature equal to about one half the time to one time the least thickness of the flange.

56. The segment according to claim 43, wherein the thickness of said head and its height measured in cross section exceed the thickness of the stem by between at least 50 percent and at most 200 percent.

57. The segment according to claim 56, wherein the thickness of said head and its height measured in cross section exceed the thickness of the stem by about 70 to 100 percent.

58. The segment according to claim 43, wherein said flange has flanks and ends and wherein said flanks taper from said cross section axis of symmetry towards the flange ends.

59. The segment according to claim 43, wherein said flange has flanks and wherein said flanks are of approximately equal thickness viewed in cross section.

60. The segment according to claim 43, wherein said flange has two ends and wherein said ends are curved approximately towards the rotor axis viewed in cross section.

61. The segment according to claims 43, wherein said head has lateral flanks which extend approximately like radial planes directed through the rotor axis.

62. The segment according to claims 43, wherein said flange has insides nearer the rotor axis than its outsides, said insides of the flanges and at least parts of the stems of adjoining segments serving as channels for the guidance of the steam generated in operation.

63. The segment according to claim 62, wherein said flange has edges and wherein recesses for the passage of the steam generated in operation to said channels are provided on said flange edges.

64. A structure for drum refiners, said drum refiners having a rotor and having segments on said rotor, said rotor having a convex outer surfaces, said segments having comminuting surfaces, said rotor being engine-driven, said rotor having an axis, said drum refiner having a material feed, said segments being provided with a projection of hammerhead-shaped cross section for anchoring on said convex outer surface of said rotor, said hammerhead having an axis of symmetry, said rotor being provided wit at least one surface provided with comminuting elements composed of said segments, said surfaces being inclined to said rotor axis and said at least one inclined surface having a diameter increasing away from said material feed, said segment being of T-shaped cross section with a stem and a flange, said stem and said flange being of slim configuration, said projection of hammerhead-shaped cross section having a head situated at the end of the segment nearest to said rotor axis, transition surfaces being provided between said stem and said head and said transition surfaces form said stem to said head viewed in cross section forming an angle of between 15 and 75 degrees open towards said head with the axis of symmetry of the hammerhead being symmetrical in cross section and for the releasable anchoring of the hammerheads of the segments, rotor webs of hammerhead-shaped cross section grasp the segment hammerheads, said segment hammerheads and said rotor hammerheads having heads, the thickness of the heads of the rotor hammerheads substantially exceeding the thickness of the heads of the segment hammerheads.

65. The structure according to claim 64, wherein the thickness of the heads of the rotor hammerheads exceeds the thickness of the heads of the segment hammerheads by 50 to 150 percent.

66. The structure according to claim 65, wherein the thickness of the heads of the rotor hammerheads exceeds the thickness of the heads of the segment hammerheads by about 75 percent.

67. The structure according to claim 64, wherein said rotor webs have a head and a stem, transition surfaces between said head and said stem of said rotor webs, said surfaces viewed in cross section being inclined, whose angles of inclination are largely equal to the angle of inclination of said segments in the transition surfaces between the head and the stem of the segment hammerhead.

68. The structure according to claim 64, wherein viewed in cross section the hammerhead-shaped rotor webs have rounded transitions in the area of accommodation of the segment hammerheads and gripping means for anchoring the segments are provided in the rotor.

69. The structure according to claim 64, wherein the segment hammerheads are grasped with clearance by the hammerhead-shaped webs and wherein grooves formed by the hammerhead-shaped rotor webs and gripping means are provided between the end of the segment hammerheads close to the rotor axis and the bottom of said rotor grooves.

70. The structure according to claim 69, wherein the gripping means have the form of wedges.

71. The structure according to claim 69, wherein the gripping means are selected from the group consisting of elliptical hollow bodies and oval hollow bodies.

72. The structure according to claim 71, wherein the hollow bodies are at leas partially slotted.

73. The structure according to claim 71, wherein the hollow bodies are pipes.

74. The structure according to claim 69, wherein the gripping means are unround bolts.

75. The structure according to claim 64, wherein said flanges of said segment hammerheads have two halves, said hammerheads of said rotor webs have outer surfaces, steam evacuation channels are formed between said stems and said flange halves of adjacent segments and said outer surfaces of the hammerheads of the rotor webs.

76. The structure according to claim 75, wherein there are recesses in the heads of the flanges of said segment hammerheads, said recesses forming channels which are connected with said steam evacuation channels.

77. The structure according to claim 64, wherein the supporting width of the transition surfaces between said stem of the segment and said head of the segment hammerhead and the corresponding portions of the rotor web are less than the width of the head of the segment hammerhead and the length of the stem.

78. The structure according to claim 77, wherein said supporting width amounts to 15 to 30 percent of the entire width of the head of the hammerhead segment.

79. The structure according to claim 78, wherein said supporting width amounts to about 20 percent of the entire width of the head of the hammerhead segment.

80. The structure according to claim 64, wherein there are grooves formed by the hammerhead-shaped rotor webs, the bottoms of said grooves between the rotor webs being adapted to the shape of the respective gripping means.

81. The structure according to claim 80, wherein the bottoms of said grooves are rounded.

82. The structure according to claim 80, wherein the bottoms of said grooves are flattened.

83. A structure for drum refiners having a rotor and having segments on said rotor, said rotor having a convex outer surface, said segments having precrushing surfaces, said rotor being engine-driven, said rotor having an axis said drum refiners having a material feed, said segments being provided with a projection of hammerhead-shaped cross section for anchoring on said convex outer surface of said rotor, said hammerhead having an axis of symmetry, said rotor being provided with at least one surface provided with precrushing elements composed of comminuting segments, said surfaces being parallel to said rotor axis, said segments being of T-shaped cross section with a stem and a flange, said stem and said flange being of slim configuration, said projection of hammerhead-shaped cross section having a head situated at the end of the segment nearest to said rotor axis, transition surface being provided between said stem and said head and said transition surfaces from said stem to said head viewed in cross section forming an angle of between 15 and 75 degrees open towards said head with the axis of symmetry of the hammerhead being symmetrical in cross section and for the releasable anchoring of the hammerheads of the segments, rotor webs of hammerhead-shaped cross section grasps the segment hammerheads, said segment hammerheads and said rotor hammerheads having heads, the thickness of the heads of the rotor hammerheads substantially exceeding the thickness of the heads of the segment hammerheads.

84. A structure for drum refiners, said drum refiners having a rotor and having segments on said rotor, said rotor having a convex outer surface, said segments having comminuting surfaces, said rotor being engine-driven, said rotor having an axis, said drum refiners having a material feed, said segment being provided with a projection of hammerhead-shaped cross section for anchoring on said convex outer surface of said rotor, said hammerhead having an axis of symmetry, said rotor being provided with at least one surface provided with precrushing elements and with at least one surface provided with grinding elements both elements composed of said comminuting segments, said at least one surface with precrushing elements extending approximately parallel to said rotor axis and with at least one surface with grinding elements being inclined to said rotor axis and said at least one inclined surface having a diameter increasing away form said material feed, said segments being of T-shaped cross section with a stem and a flange, said stem and said flange being of slim configuration, said projection of hammerhead-shaped cross section having a head situated at the end of the segment nearest to said rotor axis, transition surfaces being provided between said stem and said head and said transition surfaces from said stem to said head viewed in cross section forming an angle of between 15 and 75 degrees open towards said head with the axis of symmetry of the hammerhead being symmetrical in cross section and for the releasable anchoring of the hammerheads of the segments, rotor webs of hammerhead-shaped cross section grasp the segment hammerheads, said segment hammerheads and said rotor hammerheads having heads, the thickness of the heads of the rotor hammerheads substantially exceeding the thickness of the heads of the segment hammerheads.

* * * * *